US006394698B1

(12) United States Patent
Christiansen

(10) Patent No.: US 6,394,698 B1
(45) Date of Patent: May 28, 2002

(54) ARRANGEMENT AND METHOD FOR DIVERTING TIDAL FLOWS IN BRACKISH FAIRWAYS

(76) Inventor: Hermann Christiansen, Pappelweg 30, Buchholz, D-21244 (DE)

( * ) Notice: Subject to any disclaimer, the term of this patent is extended or adjusted under 35 U.S.C. 154(b) by 0 days.

(21) Appl. No.: 09/586,141

(22) Filed: Jun. 2, 2000

(30) Foreign Application Priority Data

Jun. 4, 1999 (DE) ..... 199 25 604

(51) Int. Cl.[7] ..... E02B 3/02
(52) U.S. Cl. ..... 405/80; 405/74; 405/15
(58) Field of Search ..... 405/15, 21, 22, 405/28, 31, 34, 80, 84, 74

(56) References Cited

U.S. PATENT DOCUMENTS

| | | | | |
|---|---|---|---|---|
| 807,987 A | * | 12/1905 | Ambler | 405/80 |
| 2,068,537 A | * | 1/1937 | Dorn | 405/28 |
| 3,667,234 A | * | 6/1972 | DeLizasoain | 405/80 |
| 4,560,304 A | * | 12/1985 | Jenkins et al. | 405/15 |
| 4,884,917 A | * | 12/1989 | Christiansen | 405/80 |
| 5,567,079 A | | 10/1996 | Felder | 405/80 |
| 5,833,389 A | * | 11/1998 | Sirovich et al. | 405/80 |
| 5,857,805 A | * | 1/1999 | Chappell | 405/80 |

FOREIGN PATENT DOCUMENTS

| | | | |
|---|---|---|---|
| DE | 33636 | | 11/1885 |
| DE | 3707074 | | 6/1988 |
| DE | 4240257 | | 6/1994 |
| FR | 2429870 | * | 1/1980 |

OTHER PUBLICATIONS

Publication–"Vermeidung von Sedimentationszonen bei seitlicher Flusswasserent–nahme" Von Edzard Hafner, Flussbau, pp. 290–294 (undated).
Publication–Erfahrungen mit der Strömungsumlenkwand, Dr.–Ing. Hermann Christiansen, Hansa—Schiffahrt—Schiffbau—Hafen—134. Jahrgang–1997—Nr. 12, pp. 70–73.

* cited by examiner

*Primary Examiner*—David Bagnell
*Assistant Examiner*—Frederick L. Lacman
(74) *Attorney, Agent, or Firm*—Nils H. Ljungman & Associates

(57) ABSTRACT

Arrangement for fairways in brackish water tidal zones to prevent or minimize deposits of silt and/or sand in a branch or enlargement of such fairways. The invention is realized by the installation of a flow wall system. At the entrance to the branch or expansion, a current deflection wall is submerged in the fairway at an upper level some distance from the bank so that a channel is formed near the entrance to the branch or enlargement to direct an flood tide into the branch or enlargement and a deflection sill is juxtaposed with the partition at a lower level to divert an incoming near-bed current of the fairway away from the entrance to the branch or enlargement. The cross sectional area of the channel is small when compared with the cross sectional area of the entrance to the branch or enlargement.

25 Claims, 4 Drawing Sheets

Section IV-IV

FIG. 5
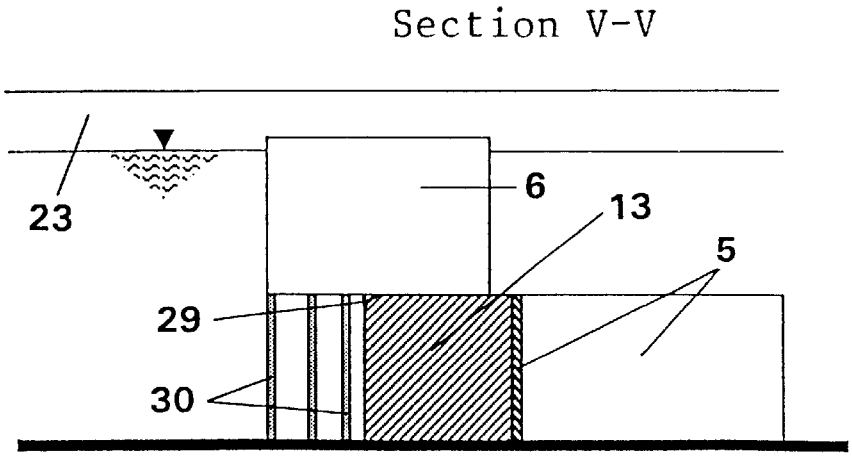
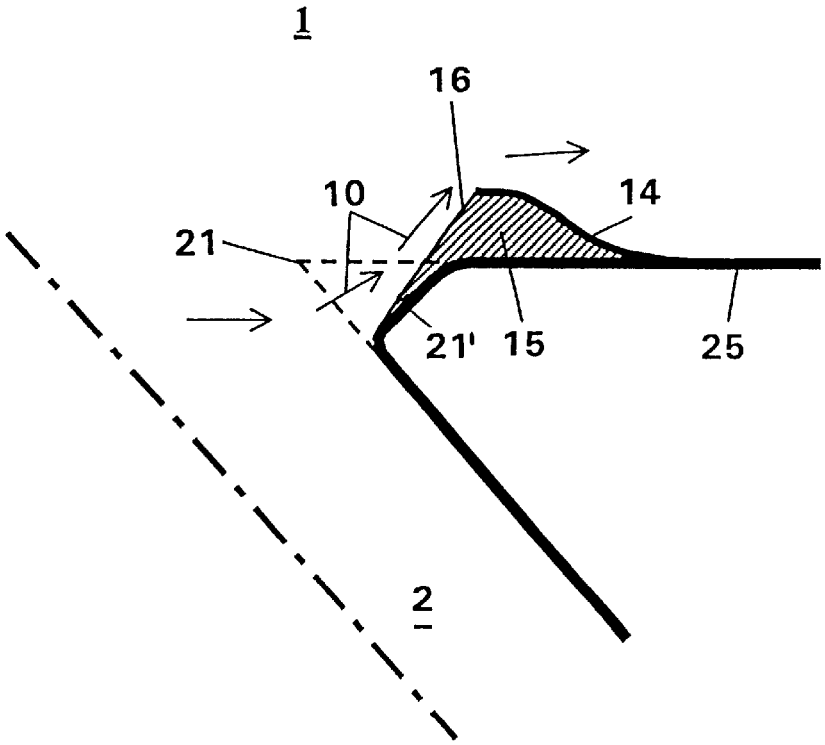
FIG. 6

ARRANGEMENT AND METHOD FOR DIVERTING TIDAL FLOWS IN BRACKISH FAIRWAYS

BACKGROUND OF THE INVENTION

1. Field of the Invention

This invention relates to a device for fairways with changing salt concentrations or suspended sediment concentrations in brackish water areas as a result of tidal flows, with a lateral branch or enlargement in the manner of a lock entrance or a harbor basin, to prevent deposits of silt/sand, whereby in the vicinity of the beginning of the branch or enlarged portion, with respect to an incoming flood current, by means of a current deflection wall that is located at some distance from the bank, a channel is realized, the cross section area of which equals a small portion of the inlet cross section area of the branch or enlargement, and the inlet opening of which lies in the fairway in the vicinity of the beginning, and the outlet opening of which lies in the vicinity of the branch or enlargement.

In other words, and according to at least one embodiment of the present invention, this invention relates to an arrangement for minimizing the deposit of silt and/or sand in brackish fairways characterized by changing salt concentrations and/or suspended sediment concentrations resulting from tidal flows and having a lateral branch or enlargement, such as a lock entrance or a harbor basin, whereby a current deflection wall is placed offshore in the vicinity and downstream of the entrance to the lateral branch or enlargement so that a channel is formed having an inlet opening lying in the fairway in the vicinity of and downstream of the entrance to the lateral branch or enlargement and an outlet opening lying in the vicinity of the branch or enlargement, the cross sectional area of the channel equaling a small portion of the cross sectional area of the entrance to the branch or enlargement.

2. Background of the Invention

On lateral branches or enlargements of this type, one problem is that for the major part of the flood tide, the salt concentration or suspended solids contents in the watercourse is greater than in the body of water of the lateral branch or enlargement, and thus a density current originates from the fairway to the branch or expansion, which is active primarily close to the bottom and thereby carries large amounts of silt or sand along with it which, it is well known, can result in large deposits of sediment. As a result of the sediment deposits formed, there are high maintenance costs for dredging and deposition of the dredged material.

The density of a tidal fairway can vary both as a function of changes in the salt concentration as well as changes in the suspended sediment concentration. Salt concentrations can change because, during flood tide, the highly salty sea water can penetrate farther into a tidal flow, and during ebb tide, can be kept farther out to sea. The suspended sediment concentration changes during flood and ebb tide as a result of the varying location of the turbidity zone, or by the increase and decrease of the turbulent tidal currents. All these effects are caused by the tide.

Because increases in the salt content and also in the suspended sediment concentration in the fairway can be achieved a great deal more rapidly than in lateral branches or expansions, the density differences described above occur over the total length of time involved in a tide, with the result that density currents are realized, by which large amounts of sand or silt are deposited in the lateral branches.

German Patent No. 37 07 074 C1 describes a system of the prior art to prevent circulation currents in fairways by installing current deflection walls at harbor entrances, thereby reducing the resulting lenticular sedimentary deposits.

These realizations, however, cannot be used to solve the problems described above, because the object of such a system is merely to reduce the eddy currents caused by the tidal flow.

Attempts have also been made to prevent density by means of a air bubble curtain or underwater skirts suspended on buoys, thereby preventing the ingress of silt and sand. Both methods have been found to be unsatisfactory.

OBJECT OF THE INVENTION

The object of the present invention, according to at least one embodiment, is to develop an arrangement and a method for diverting tidal flows in brackish fairways that substantially solves the problems encountered in systems of the known art.

SUMMARY OF THE INVENTION

The invention teaches that the baffle partition is located in the upper portion with reference to the water depth and an additional deflection wall is located in the lower portion of the water depth in the watercourse. This additional deflection sill diverts a near-bed density current of the fairway toward the middle of the fairway, starts at the bank in the vicinity of the current deflection wall and projects into the fairway.

In other words, and according to at least one embodiment of the present invention, the invention teaches that a current deflection wall is located in the fairway at an upper level and an additional deflection sill is located at a lower level, the upper and lower levels having reference to the water depth. The additional deflection sill, which starts at the bank in the vicinity of the current deflection wall and projects into the fairway in the direction of the incoming flow, diverts a near-bed density current of the fairway toward the center of the fairway and away from the lateral branch or enlargement.

As a result, a simple deflection and filling current control system is created, whereby a near-bed density current in the lower portion of the watercourse at the beginning of the branch or enlargement is diverted by the deflection sill toward the watercourse, In the upper portion of the water area, a channel is formed in the form of a filling current control system with the bank, by means of which the quantities of water at the flood tide to fill the branch or enlargement and create a counter current for an incoming density current, and thus prevents the entry of silt and sand that is carried along near-bed into the lateral branch or enlargement.

In other words, and according to at least one embodiment of the present invention, as a result, a simple deflection and filing current control system is created, whereby a near-bed density current in the lower portion of the fairway at the beginning of the branch or enlargement is diverted by the deflection sill toward the center of the fairway while the channel at the upper level of the watercourse foams a filling current control system so that quantities of water with the incoming flood tide to fill the branch or enlargement creating a counter current to the incoming density current with the result that the silt and sand normally carried along near-bed is prevented from entry into the lateral branch or enlargement.

In one advantageous embodiment, in particular to control the ebb current, the invention teaches that in the vicinity of the end of the branch or enlargement opposite the area of the current deflection wall, starting from the bank in the fairway, a deflection sill that extends toward the middle of the fairway is located at least in the lower portion with regard to the water depth.

In other words, and according to at least one embodiment of the present invention, in one advantageous embodiment, to control in particular an ebb current, the invention teaches that a deflection sill projecting from a bank of the fairway toward the center of the fairway is located offshore in the vicinity and upstream of the entrance to the lateral branch or enlargement and opposite the site of the current deflection wall. Such a sill is located at least in the lower level with regard to the water depth.

To prevent the formation of turbulence behind the deflection sills, the invention teaches that an area between the deflection wall and bank is backfilled with material.

For this purpose, in a refinement of a realization that has favorable flow conditions, one outer edge of the area of the deflection sill filled with material is rounded The invention also teaches that the current deflection wall is located on columns, at least in the area outside the area filled with material.

In one preferred embodiment, each deflection sill is realized in an S-shape to divert the flow without creating turbulence.

The invention further teaches that the areas of the current deflection wall and the deflection sill partially overlap.

The invention further teaches that the point of the bank that lies in the vicinity of the end of the branch or enlargement opposite the current deflection wall is cut off in the downstream direction.

In other words, and according to at least one embodiment of the present invention, the invention additionally teaches that the point of the bank in the vicinity of and upstream of the entrance to the branch or enlargement opposite the baffle partition is cut off in the downstream direction.

The above discussed embodiments of the present invention will be described further hereinbelow with reference to the accompanying figures. When the word "invention" is used in this specification, the word "invention" includes "inventions", that is, the plural of "invention". By stating "invention", the Applicants do not in any way admit that the present application does not include more than one patentably and non-obviously distinct invention, and maintains that this application may include more than one patentably and non-obviously distinct invention. The Applicants hereby assert that the disclosure of this application may include more than one invention, and, in the event that there is more than one invention, that these inventions may be patentable and non-obvious one with respect to the other.

BRIEF DESCRIPTION OF THE DRAWINGS

The invention is explained in greater detail below with reference to the exemplary embodiments illustrated in the accompanying drawings, in which:

FIG. 5 is a sectional drawing along Line V—V in FIG. 3, on an enlarged scale, with a partly elevated filling current control system and rounded edge on the end of the backfilled area behind the deflection system; and FIG. 6 shows a realization of a lateral enlargement with a streamlined shape of the bank point and a backfilled area on the ebb-side end of the branch.

DESCRIPTION OF THE PREFERRED EMBODIMENT

Figure 1:
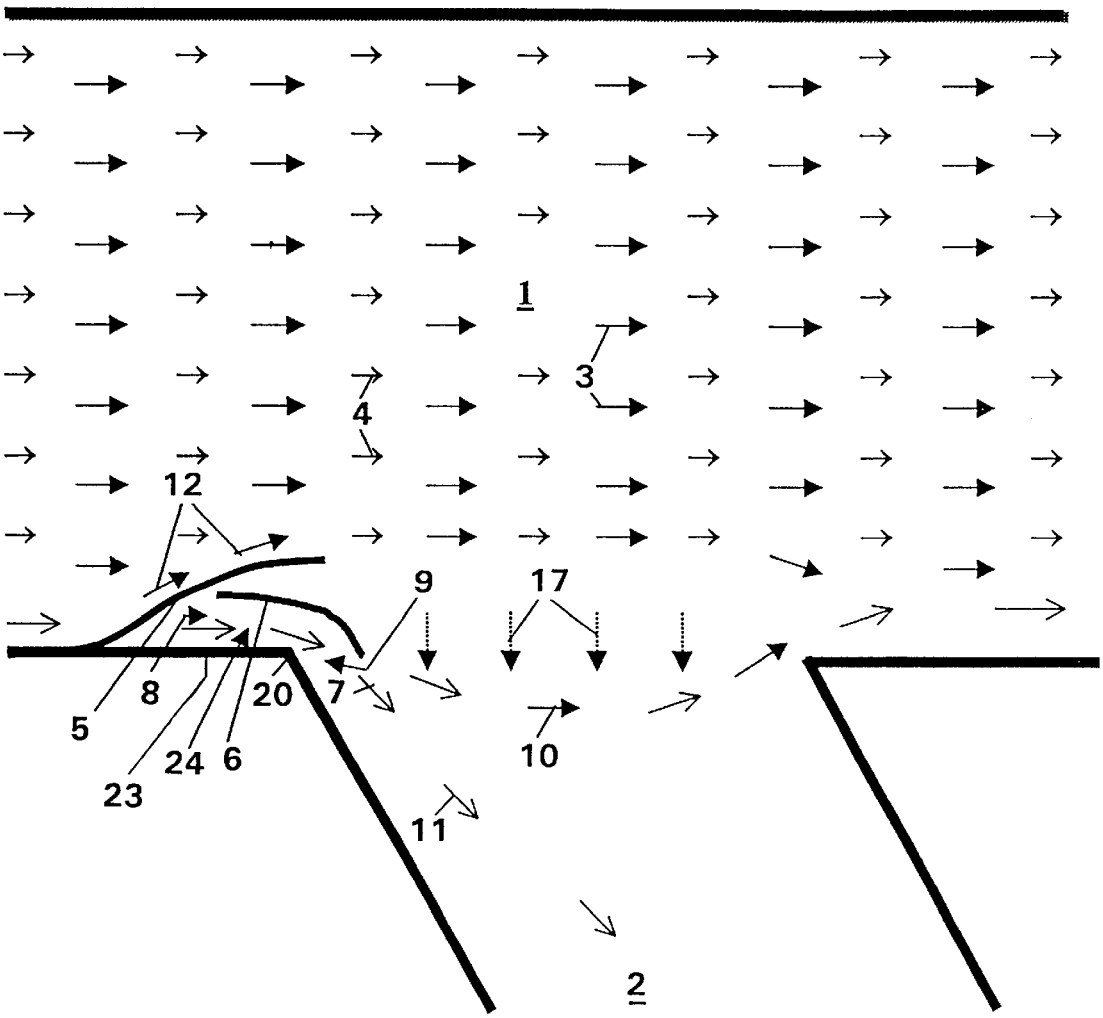
FIG. 1 is a schematic diagram of a device in action during flood tide.

In the illustrated systems, there is a river 1 as the fairway, from which a harbor basin 2 branches off. The river 1, when there is flood tide, has the tidal current 4, and also, as a result of the incoming seawater, a near-bed density current 3. At ebb tide, the arrows show the ebb current 19 and the near-bed density current 18. The arrows also show the density equalization currents at the flood tide (Arrows 17) and ebb tide (Arrows 22, which are active whenever the salt or suspended sediment concentration in the fairway 1 is greater than in harbor basin 2.

Figure 2:
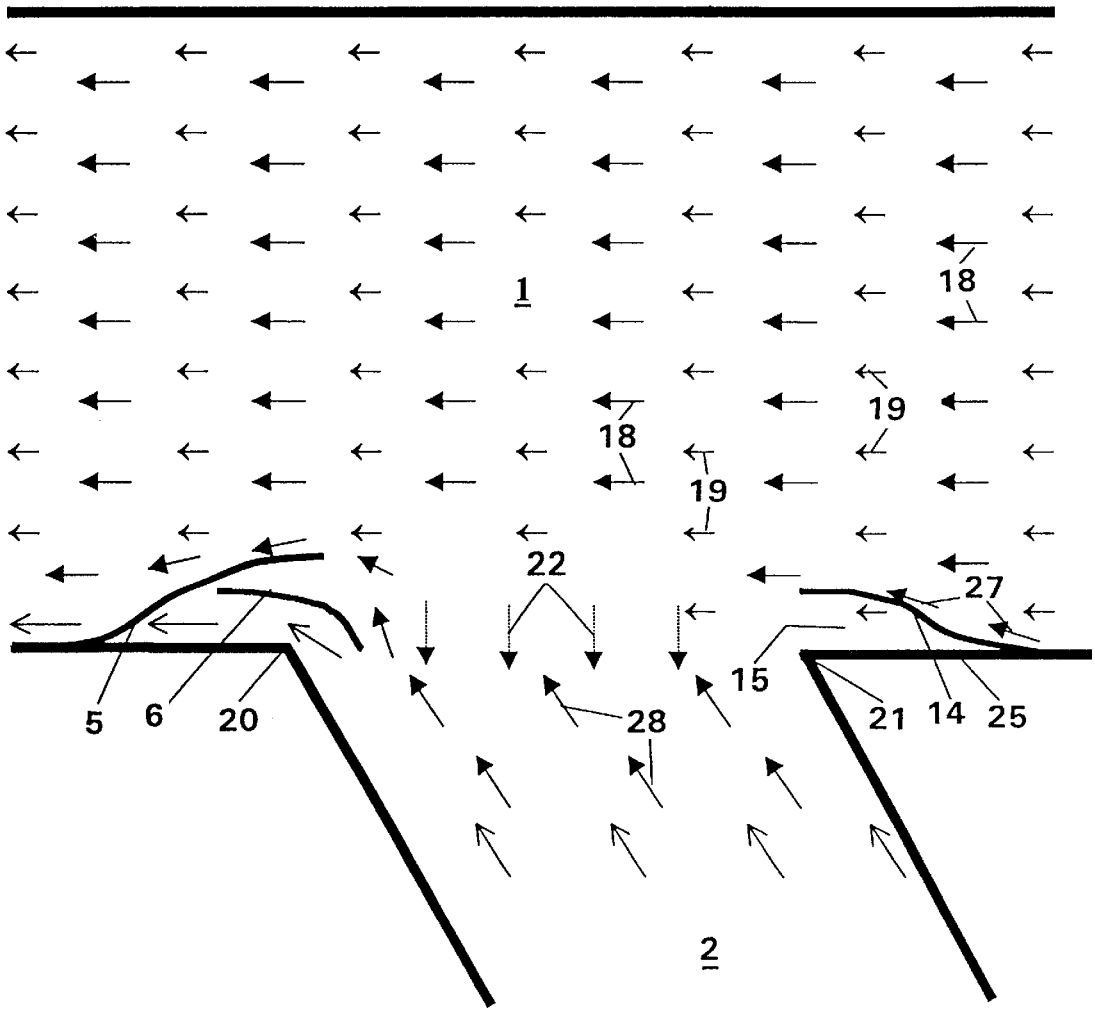
FIG. 2 is a schematic diagram of a device in action during ebb tide with deflection sills on both sides of a branch.
Figure 3:
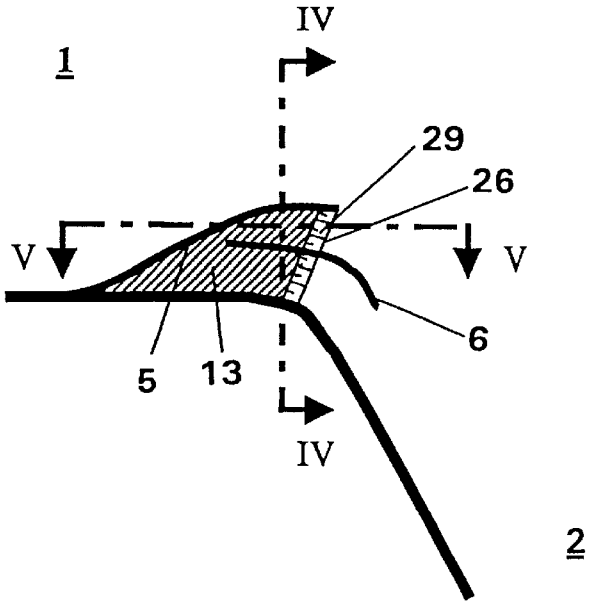
FIG. 3 shows a realization like the one illustrated in FIG. 1 as a detail with backfilling and a rounded edge of the bank as well as a rounded edge of the backfilled area.
Figure 4:
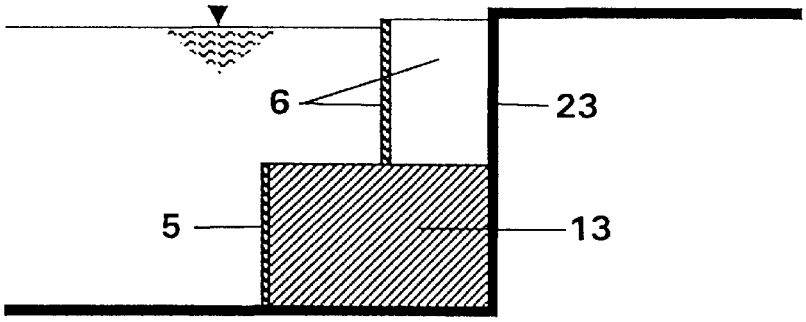
FIG. 4 is a sectional drawing along Line IV—IV in FIG. 3, on an enlarged scale.

In other words, and according to at least one embodiment of the present invention, in the illustrated systems of FIGS. 1 and 2, river 1 is shown as the fairway from which a harbor basin 2 branches off. When there is flood tide, river 1 has the tidal current 4, and also, as a result of the incoming seawater or turbidity zone, a density current 3 near the bottom. At ebb tide, the illustrated arrows represent the ebb current 19 and the density current 18 flowing in the downstream direction The arrows 17 and 22 also show the density equalization currents during flood tide and ebb tide, respectively, which are active whenever the salt or suspended sediment concentration in fairway 1 is greater than in harbor basin 2.

In the vicinity of the beginning 20 of the branch 2, there is a filling current control system with a current deflection wall 6 in the upper portion, and a deflection sill 5 in the lower portion. With the bank 23, with the current deflection wall 6, a channel 24 is formed in the upper portion of the water depth. As a result of channel 24 with the inlet opening 8 in the river area 1 and the outlet opening 9 in the transitional area between the fairway 1 and the harbor basin 2, at flood tide, a quantity of water is guided in the current direction 7. This quantity of water is split into the tidal filling volume 11 for the harbor basin 2 and a return flow portion 10 which flows back into the fairway 1, and displaces a density equalization current 17 back into the fairway 1.

In the area 20, a deflection sill 5 is also located in the lower portion of the water depth behind which, up to the bank 23, a space 13 is backfilled up to an approximately vertical closing wall 26 with material, e.g. with sand or rocks. During flood tide, the S-shaped deflection sill 5 that begins at the bank 23 and extends in the fairway 1 in the vicinity of the beginning 20 of the branch 2 displaces the density current 3 close to the bottom as shown by the arrows 12 away from the harbor entrance 2.

The density current 12 that is diverted in this manner, in connection with the partial outflow 10, causes a density equalization current 17 during flood tide to be displaced so far from the harbor entrance 2 that it remains in the fairway 1. As a result of this displacement, the deposits of sand and silt that would otherwise be carried along by the density equalization current in the vicinity of the bottom of the fairway, and the resulting high sedimentation in the harbor basin 2, can be prevented. At the end of he branch 2, beginning at the bank 25, there is a deflection sill 14 which is located in the lower portion of the water depth, and extends in an S-shaped curve into the fairway 1. The area 15 between the deflection wall 14 and the bank 25, like the area 13, is backfilled with material up to the vertical closing wall 16.

The purpose of the deflection sill 14, during ebb tide, with the tidal current 19 and the density current 18, is to deflect this density current 18 as shown by the arrows 27, so that in combination with an outflow 28 from the harbor basin 2, the penetration of a density equalization current 22 is prevented, and in this manner a deposit of silt or sand in the harbor basin 2 that would otherwise occur during ebb tide can be prevented.

Steel, reinforced concrete or wood are suitable materials for the construction of the deflection systems.

The closure wall 26 of the backfilled area 13 for the deflection sill 5 is realized in a streamlined rounded shape 29.

FIG. 6 illustrates a streamlined variant of a bank point 21 in connection with the deflection sill 14 and a streamlined closure wall 16 of a backfilled area 15 and a likewise =streamlined, cut-off bank point 21', which work together at flood tide to improve the outflow of a partial current 10.

In the exemplary embodiment illustrated in FIG. 5, the current deflection wall 6 is located outside the backfilled area 13 of the deflection sill 5 on elevated pilings in the form of columns 30.

One feature of the invention resides broadly in the device for a fairway that has changing salt concentrations and/or suspended sediment concentrations in brackish water as a result of tidal flows, with a lateral branch or expansion in the manner of a lock entrance or a harbor basin, for the prevention of silt and/or sand deposits, whereby in the vicinity of the beginning of the branch of expansion, with respect to a flood tide current; by means of a current deflection wall that is located at some distance from the bank, a channel is formed, the cross sectional area of which represents a small portion of the inlet cross sectional area of the-branch or expansion, and the inlet opening of which lies in the fairway in the vicinity of the beginning and the outlet opening of which lies in the vicinity of the branch or expansion, characterized by the fact that the current deflection wall 6 is located in the upper area with respect to the water depth, and in the lower area with respect to the water depth in the fairway there is an additional deflection sill 5, which diverts a near-bed density current toward the center of the river, runs outward from the bank 23 in the vicinity of,the current deflection wall 6 and projects into the fairway 1.

Another feature of the invention resides broadly in the device characterized by the fact that in the vicinity 21 of the end of the branch or enlargement 2 opposite the current deflection wall 6, starting from the bank 25 in the fairway 1 there is a deflection sill 14 that extends toward the middle of the river, at least in the lower portion with respect to the water depth.

Yet another feature of the invention resides broadly in the device characterized by the fact that an area 13, 15 between the deflection wall 5, 14 and the bank 23, 25 is filled with material.

Still another feature of the invention resides broadly in the device characterized by the fact that one edge 16, 26 of the area 13, 15 of the deflection sill 5, 14 backfilled with material is rounded on top.

A further feature of the invention resides broadly in the device characterized by the fact that the current deflection wall 6 is located on columns 30 at least in the vicinity outside the area 13 that is backfilled with material.

Another feature of the invention resides broadly in the device characterized by the fact that each deflection sill 5, 14 is realized in an S-shape to divert the current without forming turbulence.

Yet another feature of the invention resides broadly in the device characterized by the fact that the areas of the current deflection wall 6 and the deflection sill 5 partly overlap .

Still another feature of the invention resides broadly in the device characterized by the fact that the bank point 21' that lies in the vicinity 22 of the end of the branch or expansion 2 opposite the current deflection wall 6 is cut off in the downstream direction.

Some examples of rounded or streamlined structures in tidal streams and the may be found in the following U.S. Pat. Nos.: 4,330,224, 4,498,806, 4,665,578, 4,846,004, 4,881,848, 4,887,361, 4,923,335, 5,067,851, 5,165,357, 5,707,265 and 5,725,326.

The components disclosed in the various publications, disclosed or incorporated by reference herein, may be used in the embodiments of the present invention, as well as, as equivalents thereof.

The appended drawings in their entirety, including all dimensions, proportions and/or shapes in at least one embodiment of the invention, are accurate and to scale and are hereby included by reference into this specification.

All, or substantially all, of the components and methods of the various embodiments may be used with at least one embodiment or all of the embodiments, if more than one embodiment is described herein.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clauses, if any, are intended to cover the structure described herein as performing the recited function and not only structural equivalents but also equivalent structures.

The invention as described hereinabove in the context of the preferred embodiments is not to be taken as limited to all of the provided details thereof, since modifications and variations thereof may be made without departing from the spirit and scope of the intention.

What is claimed is:

1. An arrangement to minimize the deposit of silt or sand in a lateral branch or enlargement of a brackish fairway which is characterized by changing salt concentrations or suspended sediment concentrations as a result of tidal flows, said arrangement comprising:

an S-shaped deflection sill having at least a portion conformed to divert a near-bed current of said fairway toward the center and away from an entrance to said branch or enlargement without causing substantial turbulence upon the occurrence of a flood tide, said deflection sill being configured to be submerged along a bank of said fairway with at least a portion thereof at a predetermined depth at the level of said current, said deflection sill located downstream of and adjacent to the entrance of said branch or enlargement and projecting obliquely from said bank into said fairway in the direction of said flood; and a current deflection wall conformed to channel a tidal current of said fairway into said branch or enlargement upon the occurrence of a flood tide to aid in filling said branch or enlargement to create a current counter to an in flowing near-bed current near the bottom at said entrance to said branch or enlargement generated by said flood tide, said current deflection wall being configured to be juxtaposed to overlap with said deflection sill in said fairway and be at least partially downstream of the entrance to said bank or enlargement and situated a predetermined distance from said bank thereby forming an inlet opening lying downstream of said entrance and an outlet opening lying essentially in said branch or enlargement with at least a portion of said current deflection wall being configured to be disposed at a higher elevation than said portion of said deflection sill configured to divert said near-bed current of said fairway toward the center of said fairway.

2. The arrangement as claimed in claim 1 further comprising:

a second S-shaped deflection sill having at least a portion conformed to divert a near-bed current of said fairway toward the center and away from the entrance to said branch or enlargement without causing substantial turbulence upon the occurrence of an ebb tide, said second deflection sill being configured to be submerged along a bank of said fairway with at least a portion thereof at a predetermined depth at the level of said current, said second deflection sill located upstream of and adjacent to the entrance to said branch or enlargement and projecting obliquely from said bank into said fairway in the direction of said ebb tide.

3. The arrangement as claimed in claim 2 wherein at least one of the areas in said fairway between said bank and said submerged obliquely projecting deflection sills is backfilled with material and one edge of at least one backfilled area is rounded on top.

4. The arrangement as claimed in claim 3 wherein any portion of said current deflection wall not in physical contact with said deflection sill is supported by one or more columns extending from the bottom of said fairway.

5. The arrangement as claimed in claim 2 wherein the point of the upstream bank of said fairway located at said entrance to said branch or enlargement is cut off in the downstream direction.

6. An arrangement to minimize the deposit of silt or sand in a brackish fairway characterized by changing salt concentrations or suspended sediment concentrations as a result of tidal flows and having a lateral branch or enlargement, said arrangement comprising:

a deflection sill conformed to divert a near-bed current in said fairway toward the center of said fairway and away from an entrance to said branch or enlargement during a flood tide, said deflection sill being configured to be:

(a) submerged along the bank of said fairway with at least a portion thereof at a predetermined depth at the level of said current, (b) located downstream of and adjacent to said entrance, and (c) projected obliquely from said bank into said fairway in the direction of said flood in order to effect the diversion of said near-bed current during said flood tide; and a current deflection wall conformed to channel a tidal current of said fairway into said branch or enlargement during a flood tide to aid in filling said branch or enlargement to create a counter current to a near-bed current in said entrance to said branch or enlargement generated by said flood tide, said current deflection wall being configured to be:

(d) juxtaposed with said deflection sill in said fairway but with at least a portion of said current deflection wall being disposed at a higher elevation than the portion of said deflection sill configured to divert the near-bed current toward the center of said fairway, and (e) situated at a predetermined location with respect to and a predetermined distance from said bank in order to channel said tidal current into said branch or enlargement to create a counter current to said near-bed current said entrance to said branch or enlargement.

7. The arrangement as claimed in claim 6 further comprising:

a second deflection sill conformed to divert a current in said fairway near the bottom toward the center of said fairway and away from the entrance to said branch or enlargement during an ebb tide, said second deflection sill configured to be:

(f) submerged along a bank of said fairway with at least a portion thereof at a predetermined depth at a level of said outgoing current, (g) located upstream of and adjacent to said entrance, and (h) projected obliquely from said bank into said fairway in the direction of said outgoing flowing order to effect the diversion of said near-bed current during said ebb tide.

8. The arrangement as claimed in claim 7 wherein said second deflection sill is S-shaped in order to effect the diversion of said near-bed current during said ebb tide without forming substantial turbulence.

9. The arrangement as claimed in claim 6 wherein said deflection sill is S-shaped in order to effect the diversion of said near-bed current during said flood tide without forming substantial turbulence.

10. An arrangement for minimizing the deposit of silt or sand in a brackish fairway characterized by changing salt concentrations or suspended sediment concentrations as a result of tidal flows and having a lateral branch or enlargement, said arrangement comprising:

a deflection sill having at least a portion submerged along a bank of said fairway at a predetermined depth downstream of and at least substantially adjacent to an entrance to said branch or. enlargement and projecting from said bank into said fairway, said deflection sill being configured to divert a portion of an incoming current of said fairway toward the center of said fairway and away from said entrance to said branch or enlargement; and a current deflection wall juxtaposed with said sill in said fairway and situated at a predetermined location with respect to said bank and a predetermined distance from said bank, said current deflection wall being configured to channel a portion of a flood tide into said branch or enlargement to create a counter current to a near-bed current in said entrance to said branch or enlargement generated by said flood tide.

11. The arrangement as claimed in claim 10, wherein said submerged at least a portion of said deflection sill being configured to divert a portion of a flood current of said fairway toward the center of said fairway and away from said entrance to said branch or enlargement being disposed at a greater depth than said at least a portion of said current deflection wall being configured to channel a portion of said flood tide.

12. The arrangement as claimed in claim 11, wherein said cross-sectional area of said channel is substantially smaller than said cross-sectional area of said branch or enlargement.

13. The arrangement as claimed in claim 12 wherein said submerged deflection sill projects obliquely from said bank into said fairway in the direction of said flood and an area in said fairway between said bank and said submerged deflection sill is backfilled with material.

14. The arrangement as claimed in claim 13 wherein one edge of said backfilled area is rounded on top.

15. The arrangement as claimed in claim 14 wherein said deflection sill is S-shaped.

16. The arrangement as claimed in claim 10 wherein said current deflection wall partially overlaps said deflection sill.

17. The arrangement as claimed in claim 16 wherein a portion of said current deflection wall not overlapping said deflection sill is supported by columns.

18. The arrangement as claimed in claim 10 further comprising: a second deflection sill having at least a portion submerged along a bank of said fairway at a predetermined depth upstream of and adjacent to the entrance to said branch or enlargement and projecting from said bank into said fairway and configured to divert a portion of an ebb current in said fairway toward the center of said fairway and away from said entrance to said branch or enlargement.

19. The arrangement as claimed in claim 18 wherein said second submerged deflection sill projects obliquely from said bank into said fairway in the direction of said ebb flow and an area in said fairway between said bank and said second submerged deflection sill is backfilled with material.

20. The arrangement as claimed in claim 19 wherein one edge of said backfilled area is rounded on top.

21. The arrangement as claimed in claim 18 wherein said second deflection sill is S-shaped.

22. The arrangement as claimed in claim 18 wherein the point of the upstream bank of said fairway located at said entrance to said branch or enlargement is cut off in the downstream direction.

23. An arrangement for minimizing the deposit of at least one of silt and sand in a brackish fairway characterized by at least one of changing salt concentrations and suspended sediment concentrations as a result of tidal flows and having a lateral branch or enlargement, said arrangement comprising:

deflection sill having at least a portion submerged along a bank of said fairway at a predetermined depth downstream of and at least substantially adjacent to an to said branch or enlargement and projecting from said bank into said fairway, said deflection sill being configured to divert a portion of a flood current of said airway toward the center of said fairway; and a current deflection wall juxtaposed with said wall in said fairway and situated at a predetermined location with respect to said bank and at a predetermined distance from said bank, said current deflection wall being configured to channel a portion of a flood tide to minimize deposit of at least one of silt and sand.

24. A method for minimizing the deposit of at least one of silt and sand in a brackish fairway characterized by at least one of changing salt concentrations and suspended sediment concentrations as a result of tidal flows and having a lateral branch or enlargement, said method comprising the steps of:

diverting a portion of a flood current of said fairway toward the center of said fairway and away from an entrance to said branch or enlargement to assist in keeping said entrance to said branch or enlargement substantially free of at least one of silt and sand; and channeling a portion or a flood tide into said branch or enlargement to create a counter current to a near-bed current in said entrance to said branch or enlargement generated by said flood tide to assist in keeping said entrance to said branch or enlargement substantially free of at least one of silt and sand.

25. A method for minimizing the deposit of at least one of silt and sand in a brackish fairway characterized by at least one of changing salt concentrations and suspended sediment concentrations as a result of tidal flows and having a lateral branch or enlargement, said method comprising the steps of:

diverting a portion of a flood current of said fairway toward the center of said fairway and away from an entrance to said branch or enlargement; and channeling a portion or a flood tide into said branch or enlargement to create a counter current to a near-bed current in said entrance to said branch or enlargement generated by said flood tide.

* * * * *

UNITED STATES PATENT AND TRADEMARK OFFICE

CERTIFICATE OF CORRECTION

PATENT NO. : 6,394,698 B1
DATED : May 28, 2002
INVENTOR(S) : Herman Christiansen It is certified that error appears in the above-identified patent and that said Letters Patent is hereby corrected as shown below:

Column 3,
Line 20, after "rounded" insert -- . --.

Column 4,
Line 18, after "(Arrows", delete "22," and insert -- 22), --.
Line 64, after "of", delete "he" and insert -- the --.

Column 5,
Line 20, before "cut-off", delete "=streamlined," and insert -- streamlined, --.
Line 38, before "or", delete "the-branch" and insert -- the branch --.
Line 46, after "vicinity", delete "of,the" and insert -- of the --.

Column 6,
Between lines 30 and 31, insert the following paragraphs:

-- All of the patents, patent applications and publications recited herein, and in the Declaration attached hereto, are hereby incorporated by reference as if set forth in their entirety herein.

The details in the patents, patent applications and publications may be considered to be incorporable, at applicants option, into the claims during prosecution as further limitations in the claims to patently distinguish any amended claims from any applied prior art. --.

Line 46, after "the", delete "intention." and insert -- invention. --.

Column 8,
Line 43, after "branch", delete "or." and insert -- or --.

UNITED STATES PATENT AND TRADEMARK OFFICE

CERTIFICATE OF CORRECTION

PATENT NO. : 6,394,698 B1
DATED : May 28, 2002
INVENTOR(S) : Herman Christiansen It is certified that error appears in the above-identified patent and that said Letters Patent is hereby corrected as shown below:

Column 9,
Line 42, before "deflection" insert -- a --.

Signed and Sealed this

Twelfth Day of November, 2002

*Attest:*

*Attesting Officer*

JAMES E. ROGAN
*Director of the United States Patent and Trademark Office*